US007914311B1

(12) United States Patent
Gallusser et al.

(10) Patent No.: US 7,914,311 B1
(45) Date of Patent: Mar. 29, 2011

(54) ANTI-VIBRATION CONNECTOR COUPLING WITH AN AXIALLY MOVABLE RATCHET RING AND A COLLAR

(75) Inventors: David Gallusser, Oneonta, NY (US); Brendon A. Baldwin, Guilford, NY (US)

(73) Assignee: Amphenol Corporation, Wallingford, CT (US)

( * ) Notice: Subject to any disclaimer, the term of this patent is extended or adjusted under 35 U.S.C. 154(b) by 20 days.

(21) Appl. No.: 12/614,154

(22) Filed: Nov. 6, 2009

(51) Int. Cl.
*H01R 4/38* (2006.01)

(52) U.S. Cl. ..... 439/321

(58) Field of Classification Search ..... 439/321, 439/318, 459, 471
See application file for complete search history.

(56) References Cited

U.S. PATENT DOCUMENTS

| | | | | |
|---|---|---|---|---|
| 2,728,895 | A | | 12/1955 | Quackenbush et al. |
| 3,601,764 | A | | 8/1971 | Cameron |
| 3,917,373 | A | | 11/1975 | Peterson |
| 4,208,082 | A | | 6/1980 | Davies et al. |
| 4,268,103 | A | | 5/1981 | Schildkraut et al. |
| 4,291,933 | A | | 9/1981 | Kakaris |
| 4,359,254 | A | | 11/1982 | Gallusser et al. |
| 4,472,013 | A | | 9/1984 | Frear |
| 4,506,942 | A | | 3/1985 | Flederbach et al. |
| 4,588,245 | A | | 5/1986 | Schwartz et al. |
| 4,629,272 | A | * | 12/1986 | Mattingly et al. ..... 439/318 |
| 4,971,501 | A | | 11/1990 | Chavez |
| 5,074,703 | A | | 12/1991 | Dawson |
| 5,188,398 | A | | 2/1993 | Parimore, Jr. et al. |
| 5,199,894 | A | | 4/1993 | Kalny et al. |
| 5,399,096 | A | * | 3/1995 | Quillet et al. ..... 439/321 |
| 5,435,760 | A | | 7/1995 | Miklos |
| 5,447,447 | A | | 9/1995 | Guss, III et al. |
| 5,458,501 | A | | 10/1995 | Lazaro, Jr. et al. |
| 5,580,278 | A | * | 12/1996 | Fowler et al. ..... 439/607.23 |
| 5,653,605 | A | * | 8/1997 | Woehl et al. ..... 439/321 |
| 5,674,087 | A | | 10/1997 | Kirma |
| 5,957,716 | A | | 9/1999 | Buckley et al. |
| 5,971,787 | A | | 10/1999 | Brown |
| 6,086,400 | A | * | 7/2000 | Fowler ..... 439/321 |

(Continued)

FOREIGN PATENT DOCUMENTS

| | | |
|---|---|---|
| EP | 0 247 814 | 12/1987 |
| EP | 0 311 338 | 4/1989 |
| EP | 0 535 867 | 4/1993 |

(Continued)

*Primary Examiner* — Chandrika Prasad
(74) *Attorney, Agent, or Firm* — Blank Rome LLP

(57) ABSTRACT

A connector coupling that comprises a connector body, a first collar rotatably coupled to the connector body that has a plurality of teeth extending from an inner surface thereof, a second collar that receives the first collar and is movable axially with respect to the first collar. A ratchet ring is supported by the connector body and has a plurality of teeth corresponding to the plurality of teeth of the first collar. The ratchet ring is axially moveable with respect to the connector body between an engaged position and a disengaged position. A biasing member is supported by the connector body adjacent the ratchet ring. The biasing member biases the ratchet ring in the engaged position. The second set of teeth of the ratchet ring engage the first set of teeth of the first collar when the ratchet ring is in the engaged position, and the second set of teeth of the ratchet ring are spaced from the first set of teeth of the first collar and the ratchet ring engages the second collar when the ratchet ring is in the disengaged position.

21 Claims, 5 Drawing Sheets

U.S. PATENT DOCUMENTS 6,123,563 A * 9/2000 Johnson et al. ..... 439/321
6,293,595 B1 9/2001 Marc et al.
6,602,085 B2 * 8/2003 Young et al. ..... 439/321
7,032,931 B2 4/2006 Austin
7,544,085 B2 * 6/2009 Baldwin et al. ..... 439/471
7,837,495 B2 * 11/2010 Baldwin et al. ..... 439/459

* cited by examiner

ANTI-VIBRATION CONNECTOR COUPLING WITH AN AXIALLY MOVABLE RATCHET RING AND A COLLAR

FIELD OF THE INVENTION

The present invention relates to anti-vibration coupling for an electrical connector. More specifically, the coupling prevents counter-rotation of the electrical connector when engaged with its mating connector and subject to vibration or shock.

BACKGROUND OF THE INVENTION

Electrical connector assemblies generally include mating plug and receptacle connectors. Often a threaded nut or collar is used to mate the plug and receptacle connectors. When an electrical connector assembly is subject to vibration or shock, however, the mating connectors of the assembly, often become loose or even decouple. The loosening or decoupling usually occurs because the coupling nut counter rotates, that is it rotates in a direction opposite the mating or locking direction, thereby compromising the integrity of both the mechanical and electrical connection between the plug and receptacle connectors.

Examples of some prior art couplings for electrical connector assemblies include U.S. Pat. No. 6,293,595 to Marc et al; U.S. Pat. No. 6,123,563; U.S. Pat. No. 6,086,400 to Fowler; U.S. Pat. No. 5,957,716 to Buckley et al.; U.S. Pat. No. 5,435,760 to Miklos; U.S. Pat. Nos. 5,399,096 to Quillet et al.; 4,208,082 to Davies et al.; U.S. Pat. No. 3,917,373 to Peterson; and U.S. Pat. No. 2,728,895 to Quackenbuash, the subject matter of each of which is hereby incorporated by reference.

SUMMARY OF THE INVENTION

Accordingly, the present invention relates to a connector coupling that comprises a connector body, a first collar rotatably coupled to the connector body that has a plurality of teeth extending from an inner surface thereof, a second collar that receives the first collar and is movable axially with respect to the first collar. A ratchet ring is supported by the connector body and has a plurality of teeth corresponding to the plurality of teeth of the first collar. The ratchet ring is axially moveable with respect to the connector body between an engaged position and a disengaged position. A biasing member is supported by the connector body adjacent the ratchet ring. The biasing member biases the ratchet ring in the engaged position. The second set of teeth of the ratchet ring engage the first set of teeth of the first collar when the ratchet ring is in the engaged position, and the second set of teeth of the ratchet ring are spaced from the first set of teeth of the first collar and the ratchet ring engages the second collar when the ratchet ring is in the disengaged position.

The present invention also relates to a connector coupling that comprises a connector body and a first collar rotatably coupled to the connector body that has a first set of spaced projections extending inwardly from the first collar and defines a plurality of slots between said projections. A first set of teeth extend from each of the projections of the first collar. A second collar receives the first collar and is movable axially with respect to the first collar and has a second set of spaced projections extending inwardly from the second collar and defines a plurality of slots between the projections. The plurality of slots of the second collar are adapted to receive the projections of the first collar, and the plurality of slots of the first collar are adapted to receive the projections of the second collar. A ratchet ring is supported by the connector body and is axially moveable with respect to the connector body between an engaged position and a disengaged position. A second set of teeth extend from the ratchet ring. The second set of teeth are complementary to first set of teeth of the first collar. A biasing member is supported by the connector body adjacent the ratchet ring which biases the ratchet ring in the engaged position. The second set of teeth of the ratchet ring engage the first set of teeth of the first collar when the ratchet ring is in the engaged position, and the second set of teeth of the ratchet ring is spaced from the first set of teeth of the first collar and the ratchet ring engages the second collar when the ratchet ring is in the disengaged position.

A connector coupling that comprises a connector body, a first collar that is rotatably coupled to the connector body, and a second collar that receives the first collar and is movable axially with respect to the first collar. A ratchet means for a one-way ratchet coupling is between the connector body and the first collar so that the first collar is rotatable with respect to the connector body in a first direction and not rotatable in a second direction opposite the first direction. The ratchet means is axially slidable with respect to the connector body between an engaged position and a disengaged position. A biasing member is supported by the connector body, which biases the ratchet means in an engaged position. The second collar engages the ratchet means when the ratchet means is in said disengaged position.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
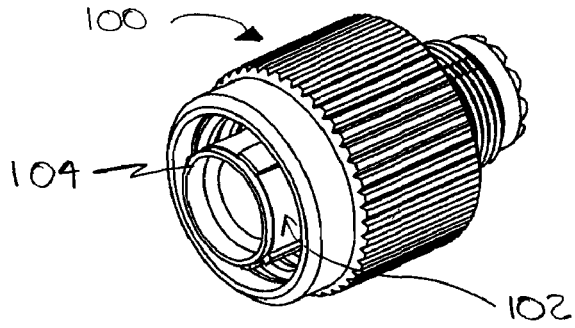
FIG. 1 is a perspective view of a coupling according to an embodiment of the present invention, showing the coupling disposed on the body of a connector.
Figure 2:
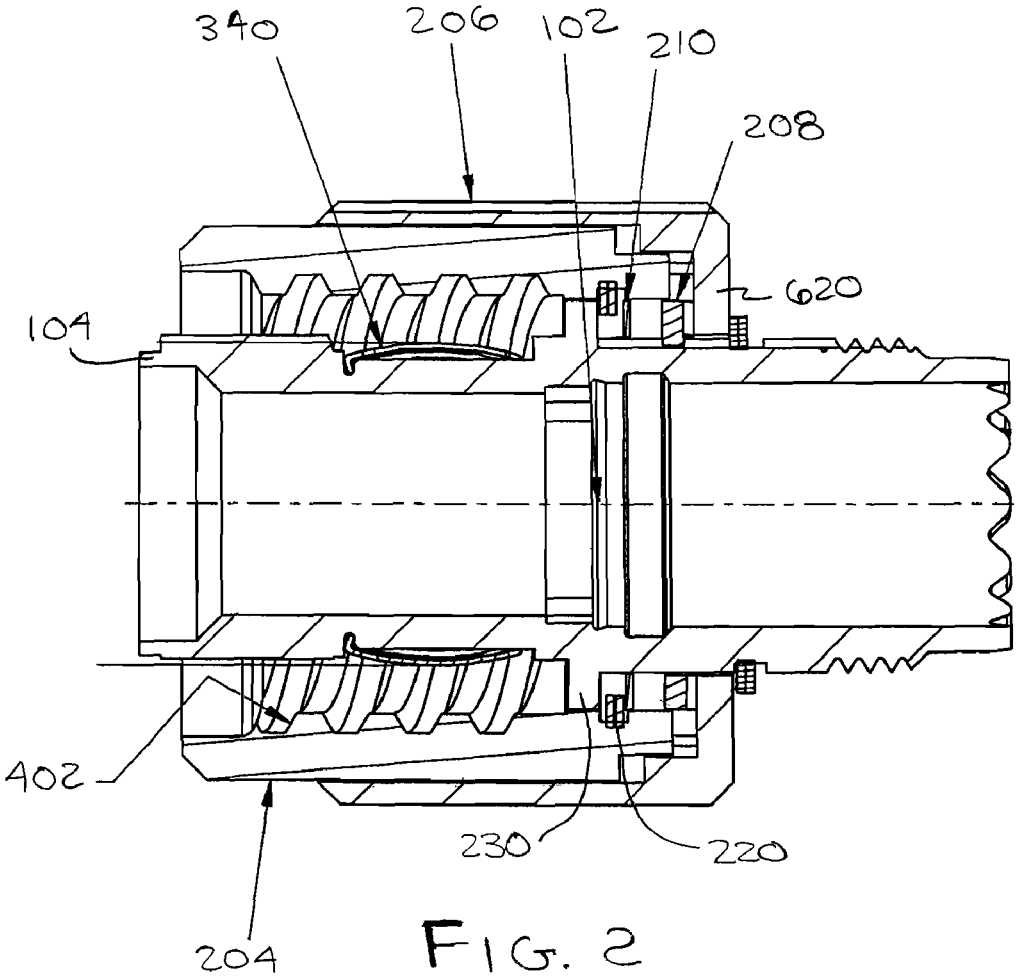
FIG. 2 is a cross-sectional view of the coupling and connector body illustrated in FIG. 1.

Referring to FIGS. 1-9, the present invention relates to an anti-vibration coupling 100 for an electrical connector assembly, such as a plug and receptacle. The coupling 100 preferably provides a one-way ratchet engagement such that the connectors of the assembly can only be disengaged manually by moving the coupling 100 between engaged (FIG. 8) and disengaged (FIG. 9) positions. The coupling 100 is preferably disposed on a connector body 102 and may include an inner collar 204, an outer collar 206, a ratchet ring 208, and a biasing member 210, as seen in FIG. 2.

FIGS. 1 and 2 illustrate the coupling 100 coupled to the connector body 102 of the connector assembly. The connector body 102 may be the shell of a plug connector, for example. In the preferred embodiment, the inner collar 204 accepts the connector body 102 and the outer collar 206 receives the inner collar 204. Both the ratchet ring 208 and the biasing member 210 are preferably disposed between the connector body 102 and the inner and outer collars 204 and 206.

Figure 4:
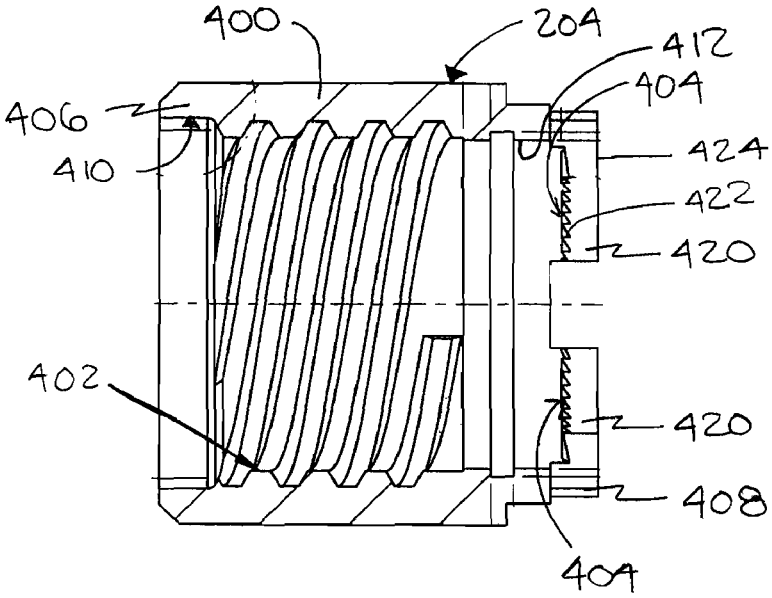
FIG. 4 is a cross-sectional view of an inner collar of the coupling illustrated in FIG. 1.
Figure 5:
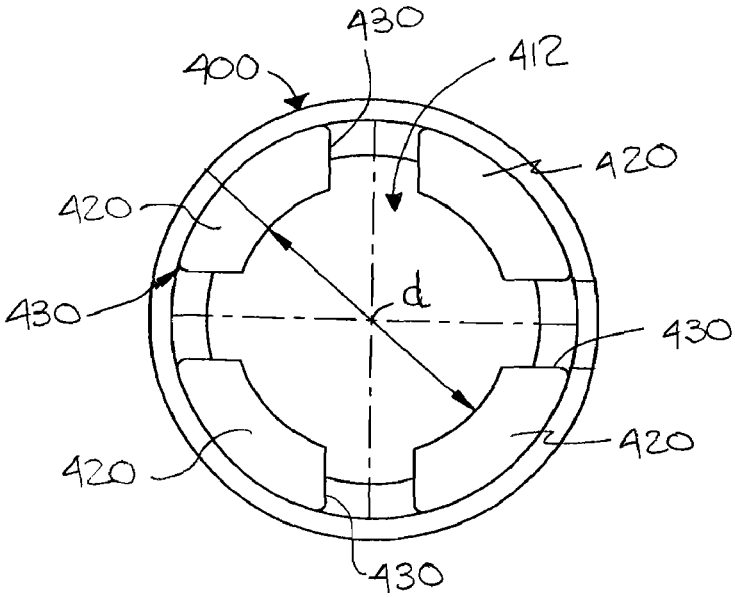
FIG. 5 is an end elevational view of the inner collar illustrated in FIG. 4.

As best seen in FIGS. 2, 4 and 5, the inner collar 204 may include a main body 400 with internal threads 402 for engaging the mating connector (not shown), such as a receptacle, and a first set of teeth 404 for engaging the ratchet ring 208. The main body 400 may include first and second opposite ends 406 and 408 that define first and second openings 410 and 412, respectively, through which the connector body 402 extends.

Extending from the second end 408 of the main body 400 is a first set of a plurality of projections 420. The projections 420 define the diameter d of the second opening 412 of the collar's main body 400 such that the second opening 412 is smaller than the first opening 410. Each projection 420 includes opposite inner and outer surfaces 422 and 424 where the inner surfaces 422 faces the internal threads 402 of the main body 400 and the outer surfaces 424 faces outside of the main body 400. Between each of the projections 420 are slots 430, as best seen in FIG. 5.

Figure 9:
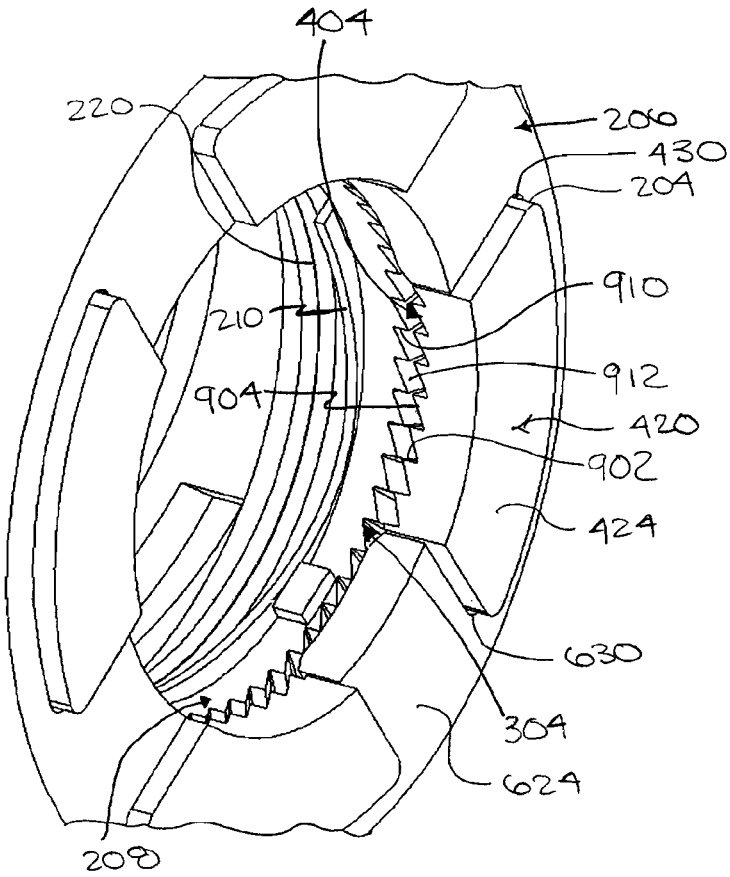
FIG. 9 is a partial end perspective view of the coupling similar to FIG. 8, showing the coupling in a disengaged position.

As seen in FIGS. 4 and 9, the first set of teeth 404 extend from the inner surfaces 422 of each projection 420. Each tooth of the first set of teeth 404 may include a flat surface 902 that is preferably substantially perpendicular to the inner surface 422 of each respective projection 420, and an angled surface 904 that is angled with respect to the flat surface 902.

Figure 3:
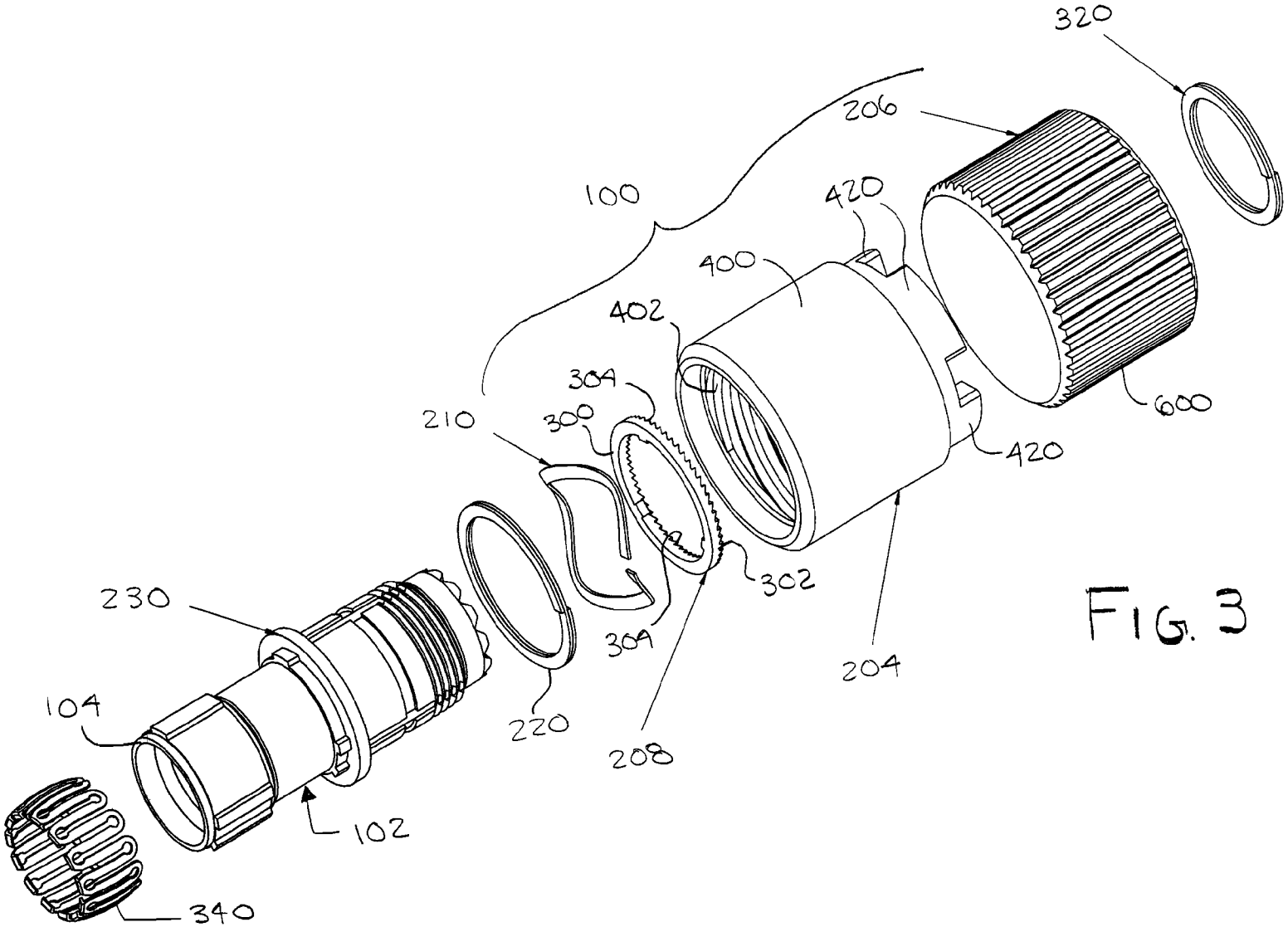
FIG. 3 is an exploded perspective view of the coupling and the connector body illustrated in FIG. 1.

The inner collar 204 is coupled to the connector body 102 such that it is rotatable with respect to the connector body 102; however its axial movement relative to the connector body 102 is restrained by a retaining clip 220 (FIGS. 2 and 3). More specifically, the retaining clip 220 surrounds the connector body 102 and resides in an inner annular groove of the inner collar 204. An outer flange 230 of the connector body 102 creates a stop to prevent the retaining clip 220 and the inner collar 204 from moving axially forward with respect to the connector body 102. Retaining ring 320 restrain axial movement of the inner collar 204 in the opposite or back direction.

Figure 6:
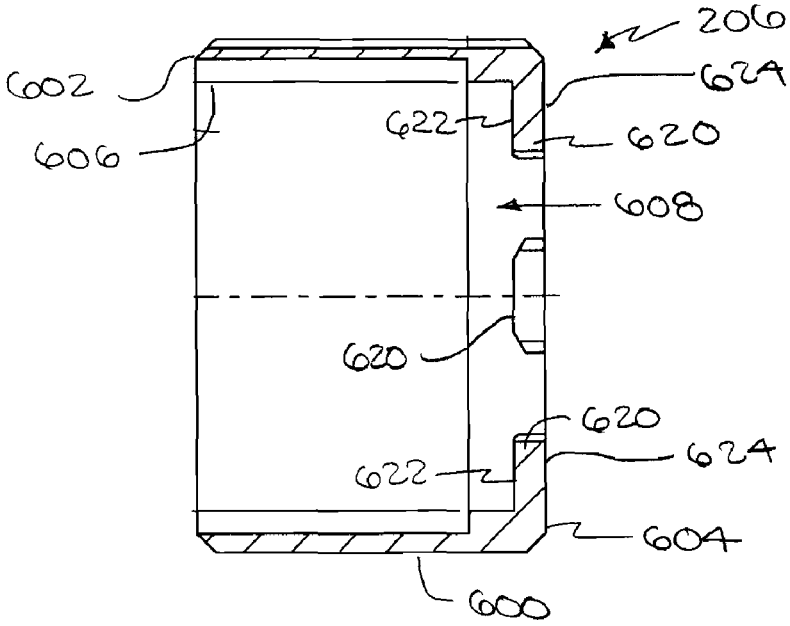
FIG. 6 is a cross-sectional view of an outer collar of the coupling illustrated in FIG. 1.
Figure 7:
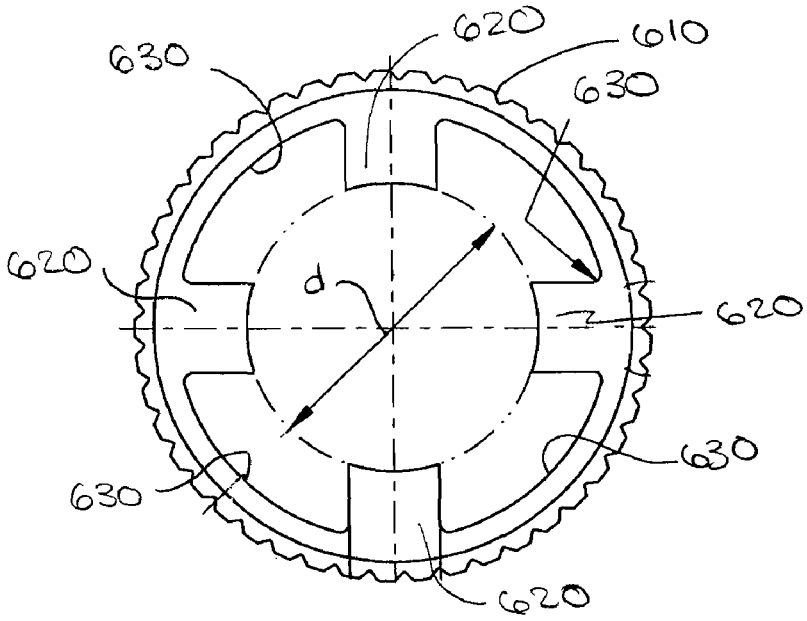
FIG. 7 is an end elevational view of the outer collar illustrated in FIG. 6.

The outer collar 206 surrounds the inner collar 204 to provide a mechanism for manually unlocking the inner collar 204. The outer collar 206 is designed to slide axially with respect to the inner collar 204 and the connector body 102. As seen in FIGS. 2, 6 and 7, the outer collar 206 generally includes a main body 600 opposite first and second ends 602 and 604 that define first and second openings 606 and 608, respectively. The first opening 606 is sized to receive the inner collar 204, and the second opening 608 is sized to receive only the connector body 102. The main body 600 may include an outer gripping surface 610 to facilitate rotational and axial movement of the outer collar 206.

Extending from the second end 604 of the main body 600 is a second set of projections 620 which define the diameter d of the second opening 608 of the main body 600. The second opening 608 of the outer collar 206 is substantially the same size as the second opening 412 of the inner collar 204. Slots 630 are defined between the projections, as best seen in FIG. 7. Each projection 620 of the second set of projections includes opposite inner and outer surfaces 622 and 624. Each projection 620 of the second set of projections is shaped to correspond to or match the slots 430 of the inner collar 204. Likewise, each projection 420 of the first set of projections is shaped to correspond to the slots 630 of the outer collar 206.

As seen in FIGS. 2 and 3, the ratchet ring 208 is positioned on the connector body 102 between its outer flange 230 and the outer collar 206. The ratchet ring 208 may include opposite first and second surfaces 300 and 302. The first surface 300 is generally flat and is adapted to engage the biasing member 210. The second surface 302 includes a second set of teeth 304 extending therefrom that are adapted to engage the first set of teeth 404 of the inner collar 204 in a one-way ratchet engagement. Similar to the teeth of the first set of teeth 404 of the inner collar 204, each tooth of the second set of teeth 304 of the ratchet ring 208 includes a first surface 910 that is generally flat such that it is substantially perpendicular to the first surface 300 of the ratchet ring 208, and a second surface 912 that is angled relative to the flat first surface 910.

When assembling the coupling 100 to the connector body 102, the connector body 102 extends through the first and second openings 410, 606 and 412, 608 of the inner and outer collars 204 and 206, respectively, with the outer collar 206 surrounding the inner collar 204. A retaining clip 320 may be provided on the connector body 102 outside of the outer collar 206, thereby retaining the inner collar 204, the outer collar 206, the ratchet ring 208 and the biasing member 210 on the connector body 102. The retaining clip 220 restricts the axially movement of the inner collar 204 relative to the connector body. A grounding band 340 may be provided between the connector body 102 and the inner collar 204.

Figure 8:
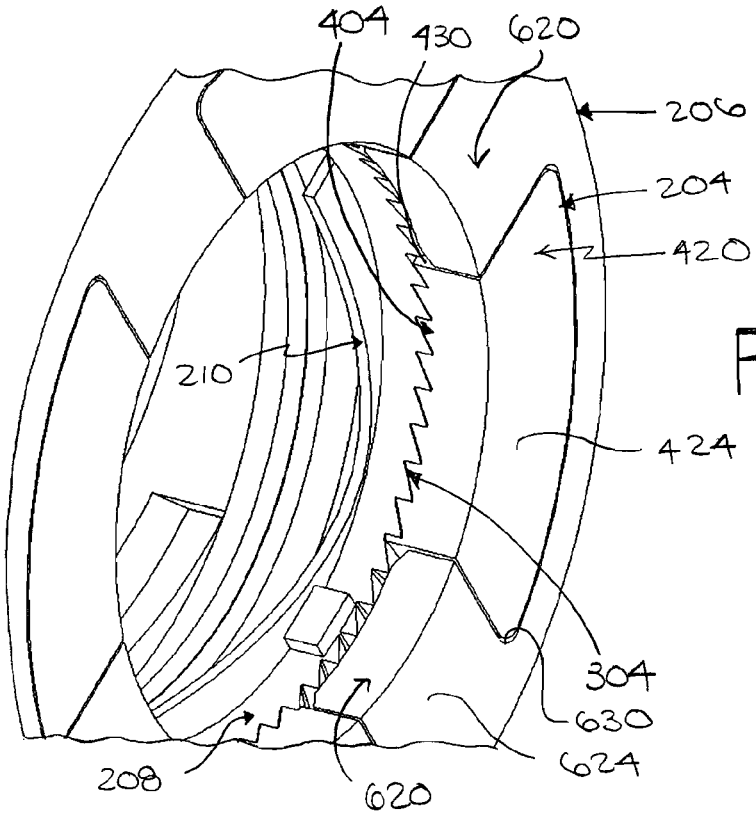
FIG. 8 is a partial end perspective view of the coupling illustrated in FIG. 1, showing the coupling in an engaged position.

The biasing member 210, which may be a wave spring, for example, biases the coupling 100 into the engaged position, as seen in FIG. 8. In the engaged position, the inner collar 204 can be rotated in only one direction to couple to the mating connector via its inner threads 402. The shaped of the teeth of the first and second sets of teeth 404 and 304 of the inner collar 204 and the ratchet ring 208, respectively, allow for rotation or ratcheting in one direction only, e.g. counterclockwise when viewed from front end 104, and not in the opposite direction, i.e. a counter rotation. This arrangement generally prevents decoupling of the mating connectors due to vibration. More specifically, the angled surfaces 904 and 912 of the teeth of the first and second sets of teeth 404 and 304 allow the inner collar 204 to rotate or ratchet, for example clockwise with respect to the ratchet ring 208 and the connector body 102. Because the flat or substantially perpendicular surfaces 902 and 910 of the teeth of the first and second sets of teeth 404 and 304 abut one another, the inner collar 204 is prevented from rotating or ratcheting back in the opposite direction.

In the engaged position, illustrated in FIG. 8, the first set of teeth 404 of the inner collar 204 are engaged with the second set of teeth 304 of the ratchet ring 208. In addition, the projections 420 of the inner collar 204 are received in the slots 630 of the outer collar 206. Similarly, the projections 620 of the outer collar 206 are received in the slots 430 of the inner collar 204. The outer surfaces 424 and 624 of the inner collar projections 420 and the outer collar projections 620, respectively, are substantially flush. Also, the inner surfaces 622 of the projections 620 of the outer collar 208 abut some of the teeth 304 of the ratchet ring 208, as best seen in FIG. 8.

The coupling 100 may be manually unlocked to allow the inner collar 204 to rotate in the opposite direction, e.g. clockwise when viewed from front end 104 of the connector body 102. The manual unlocking allows decoupling the inner threads 402 of the inner collar 204 from the mating connector. To unlock the coupling 100, the outer collar 206 is moved axially relative to the inner collar 204 and the connector body 102 in the forward direction, i.e. towards the forward end 104 of the connector body 102. The outer collar 206 moves against the biasing of the biasing member 210 to separate the first and second sets of teeth 404 and 304.

FIG. 9 illustrates the coupling 100 in the disengaged position after the coupling 100 is manually unlocked. As the outer collar 206 is moved forward, the inner surfaces 622 of the projections 620 of the outer collar 206 push against the teeth of the ratchet ring 208 and against the bias of the biasing member 210 to separate the teeth 304 from the teeth 404 of the inner collar. As seen in FIG. 9, the outer surfaces 624 and 424 of the outer collar's projections 620 and the inner collar's projections 420, respectively, are no longer flush and axially moved forward. Because the teeth 304 of the ratchet ring 208 and the teeth 404 of the inner collar 204 are now spaced from one another, the inner collar 204 may freely rotate in either direction relative to the connector body 102.

While a particular embodiment has been chosen to illustrate the invention, it will be understood by those skilled in the art that various changes and modifications can be made therein without departing from the scope of the invention as defined in the appended claims. For example, any number of projections 420 on the inner collar 204 and any number of projections 620 on the ratchet ring 208 may be employed. Also, the biasing member is not limited to a wave spring and may be any type of biasing mechanism, such as a compression spring.

What is claimed is:

1. A connector coupling, comprising of:

a connector body;

a first collar rotatably coupled to said connector body, said first collar having a plurality of teeth extending from an inner surface thereof;

a second collar receiving said first collar and being movable axially with respect to said first collar;

a ratchet ring supported by said connector body, said ratchet ring having a plurality of teeth corresponding to said plurality of teeth of said first collar, and said ratchet ring being axially moveable with respect to said connector body between an engaged position and a disengaged position; and a biasing member supported by said connector body adjacent said ratchet ring, said biasing member biasing said ratchet ring in said engaged position, wherein said second set of teeth of said ratchet ring engage said first set of teeth of said first collar when said ratchet ring is in said engaged position, and said second set of teeth of said ratchet ring being spaced from said first set of teeth of said first collar and said ratchet ring engaging said second collar when said ratchet ring is in said disengaged position.

2. A connector coupling according to claim 1, wherein said plurality of teeth of said first collar extend from spaced apart projections extending inwardly from an end of said first collar.

3. A connector coupling according to claim 2, wherein said second collar includes a plurality of spaced projections extending from an end of said second collar that correspond to slot defined between said plurality of spaced projections of said first collar.

4. A connector coupling according to claim 1, wherein said first collar is internally threaded.

5. A connector coupling according to claim 1, wherein said first collar is axially stationary with respect to said connector body.

6. A connector coupling according to claim 1, wherein said first collar being rotatably with respect to said connector body in only a single direction.

7. A connector coupling according to claim 6, wherein said plurality of teeth of said first collar ratchet with respect to said plurality of teeth of said ratchet ring in said single direction.

8. A connector coupling according to claim 7, wherein each of said plurality of teeth of said first collar has at least one substantially flat surface and at least one angled surface that is angled with respect to said substantially flat surface; and each of said plurality of teeth of said ratchet ring has a substantially flat surface and an angled surface corresponding to said substantially flat surface and said angled surface of said plurality of teeth of said first collar to provide a one-way ratchet.

9. A connector coupling according to claim 1, wherein said biasing member is disposed between an annular flange of said connector body and said ratchet ring.

10. A connector coupling according to claim 9, wherein said biasing member is a wave spring.

11. A connector coupling according to claim 1, wherein said ratchet ring is disposed between an annular flange of said connector body and said second collar.

12. A connector coupling according to claim 1, wherein said ratchet ring is disposed between said connector body and said first collar, and said ratchet ring being slidable with respect to both said connector body and said first collar.

13. A connector coupling according to claim 1, wherein said ratchet ring has opposing first and second surfaces, said first surfaces being adapted to engage said biasing member and said second surface being adapted to engage said second collar.

14. A connector coupling, comprising of:

a connector body;

a first collar rotatably coupled to said connector body, said first collar having a first set of spaced projections extending inwardly from said first collar and defining a plurality of slots between said projections;

a first set of teeth extending from each of said projections of said first collar;

a second collar receiving said first collar and being movable axially with respect to said first collar, said second collar having a second set of spaced projections extending inwardly from said second collar and defining a plurality of slots between said projections, said plurality of slots of said second collar being adapted to receive said projections of said first collar, and said plurality of slots of said first collar being adapted to receive said projections of said second collar;

a ratchet ring supported by said connector body, said ratchet ring being axially moveable with respect to said connector body between an engaged position and a disengaged position;

a second set of teeth extending from said ratchet ring, said second set of teeth being complementary to first set of teeth of said first collar; and a biasing member supported by said connector body adjacent said ratchet ring, said biasing member biasing said ratchet ring in said engaged position, wherein said second set of teeth of said ratchet ring engage said first set of teeth of said first collar when said ratchet ring is in said engaged position, and said second set of teeth of said ratchet ring being spaced from said first set of teeth of said first collar and said ratchet ring engaging said second collar when said ratchet ring is in said disengaged position.

15. A connector coupling according to claim 14, wherein said first and second of teeth form a one-way ratchet such that said first collar is rotatable with respect to said connector body in only a single direction.

16. A connector coupling according to claim 14, wherein said first set of projections extend radially inwardly from an end of said first collar, and each of said projections has opposite inner and outer surfaces.

17. A connector coupling according to claim 14, wherein each of said teeth of said first set of teeth includes at least a substantially flat surface and at least one angled surface angled with respect to said substantially flat surface.

18. A connector coupling according to claim 14, wherein said ratchet ring includes opposite first and second surfaces, said first surface being adapted to abut said biasing member and said second surface being adapted to abut said second collar.

19. A connector coupling according to claim 14, wherein each of said teeth of said second set of teeth includes at least a substantially flat surface and at least one angled surface angled with respect to said substantially flat surface.

20. A connector coupling according to claim 14, wherein said ratchet ring and said biasing member being disposed between an annular flange of said connector body and said second collar.

21. A connector coupling, comprising of:

a connector body;

a first collar rotatably coupled to said connector body;

a second collar receiving said first collar and being movable axially with respect to said first collar;

a ratchet means for a one-way ratchet coupling between said connector body and said first collar so that said first collar is rotatable with respect to said connector body in a first direction and not rotatable in a second direction opposite said first direction, said ratchet means being axially slidable with respect to said connector body between an engaged position and a disengaged position; and a biasing member supported by said connector body, said biasing member biasing said ratchet means in an engaged position, wherein said second collar engages said ratchet means when said ratchet means is in said disengaged position.

* * * * *